US006226480B1

(12) United States Patent
Hirabayashi et al.

(10) Patent No.: US 6,226,480 B1
(45) **Date of Patent: *May 1, 2001**

(54) IMAGE FORMING APPARATUS SUPPLYING CHARGING ACCELERATING PARTICLES TO IMAGE BEARING BODY IN NON-IMAGE FORMING

(75) Inventors: Jun Hirabayashi; Harumi Ishiyama, both of Numazu; Yasunori Chigono, Susono, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 10 days.

(21) Appl. No.: 09/387,568

(22) Filed: Sep. 1, 1999

(30) Foreign Application Priority Data

Sep. 4, 1998 (JP) ..... 10-267399

(51) Int. Cl.[7] ..... G03G 15/00; G03G 15/02

(52) U.S. Cl. ..... 399/222; 399/149; 399/174; 430/110

(58) Field of Search ..... 399/222, 252, 399/174, 175, 176, 149, 150, 38, 168; 430/110, 120

(56) References Cited

U.S. PATENT DOCUMENTS

| | | | | |
|---|---|---|---|---|
| 5,729,802 | | 3/1998 | Hirabayashi et al. | 399/174 |
| 5,915,150 | * | 6/1999 | Kukimoto et al. | 399/149 |
| 5,922,500 | * | 7/1999 | Iida et al. | 430/110 |
| 5,930,566 | | 7/1999 | Ishiyama | 399/168 |
| 5,933,681 | * | 8/1999 | Suzuki | 399/150 X |
| 6,038,418 | * | 3/2000 | Chigono et al. | 399/174 |
| 6,038,420 | * | 3/2000 | Hirabayashi et al. | 399/176 |

FOREIGN PATENT DOCUMENTS 11-149205 * 6/1999 (JP) .

* cited by examiner

*Primary Examiner*—Sophia S. Chen
(74) *Attorney, Agent, or Firm*—Fitzpatrick, Cella, Harper & Scinto

(57) ABSTRACT

An image forming apparatus for injection charging which uses charging accelerating particles in a charging nip portion to rotate an image bearing body and a charging roller at different velocities and applies a bias in image forming which is different from a bias applied in non-image forming to feed substantially only the charging accelerating particles in non-image forming, thereby it is possible to enhance a charging property and to provide a favorable image.

13 Claims, 6 Drawing Sheets

IMAGE FORMING APPARATUS SUPPLYING CHARGING ACCELERATING PARTICLES TO IMAGE BEARING BODY IN NON-IMAGE FORMING

BACKGROUND OF THE INVENTION

1. Field of the Invention

The present invention relates to an image forming apparatus such as a copying machine, a printer or the like which uses an electronic photographing method or an electrostatic recording method.

2. Related Background Art

A conventional image forming apparatus which uses the electronic photographing method or electrostatic recording method, for example, adopts a corona charger (corona discharger) as a charging apparatus which uniformly charges (and discharges) an image bearing body such as a photosensitive body for electronic photographs or an electrostatic recording dielectric body at a required polarity or potential.

The corona charger is a contactless type charging apparatus which is equipped, for example, with a discharging electrode such as a wire electrode and a shield electrode surrounding the discharging electrode to charge a surface of an image bearing body as predetermined by exposing the surface of the image bearing body to a discharging current (corona shower) which is produced by applying a high voltage across the discharging electrode and the shield electrode with a discharging opening set contactlessly opposed to the image bearing body which is to be charged.

In the recent days, many kinds of contact type charging apparatuses have been proposed and put to practical use as apparatuses to charge image bearing bodies and the like to be charged since this kind of charging apparatuses provide an advantage to consume ozone and electric power at lower rates than the corona charger.

The contact type charging apparatus brings an electrically conductive charging member of roller (charging roller) type, fur brush type, magnetic brush type or blade type into contact with a body to be charged such as an image bearing body and charges a surface of the body to be charged at a predetermined polarity and a predetermined potential by applying a predetermined bias to the charging member (contacting charging member or contacting charger hereinafter referred to as a contacting charging member).

In a mechanism of contacting charging (charging mechanism or charging principle), (1) a discharging charging mechanism is mixed with (2) an injection charging mechanism and one of the mechanisms which is governing exhibits its characteristic.

(1) Discharging Charging Mechanism

The discharging charging mechanism is a system which charges a surface of a body to be charged utilizing a discharge phenomenon which takes place in a fine gap between the contacting charging member and the body to be charged.

Since the discharging charging mechanism has definite discharging threshold values for the contacting charging member and the body to be charged, it requires applying a voltage higher than a charging potential to the contacting charging member. Furthermore, the discharging charging mechanism is inevitably accompanied by an adverse influence due to active ions such as ozone since it is based on a principle which is inherently incapable of preventing a product from being formed by discharging though in an amount remarkably smaller than that of a product produced by the corona charger.

(2) Injection Charging Mechanism

The injection charging mechanism is a system which charges the surface of the body to be charged by injecting electric charges from the contacting charging member directly into the body to be charged. This charging is referred to also as direct charging, injection charging or electric charge injection charging.

Describing in more detail, the injection charging mechanism brings a contacting charging member having medium resistance into contact with the body to be charged and injects electric charges directly into the surface of the body to be charged not by way of the discharging phenomenon, or basically not using the discharging phenomenon. Therefore, the injection charging mechanism is capable of charging the body to be charged at a potential corresponding to a voltage applied to the body to be charged even when the voltage is lower than a discharging threshold value. The injection charging mechanism allows no product to be formed by discharging and is not accompanied by the adverse influence due to a product formed by discharging without any generation of ions.

However, a charging property of the injection charging mechanism is largely dependent on a contact condition of the contacting charging member which is brought into contact with the body to be charged. Accordingly, the injection charging mechanism requires composing the contacting charging member so that it is denser, rotated at a velocity having a larger difference from a rotating velocity of the body to be charged and brought into contact with the body to be charged at a higher frequency.

The inventors have therefore proposed novel charging methods which inject electric charges by way of electrical conductive particles in U.S. patent application Ser. Nos. 35,108, 35,109 and 35,022.

U.S. patent application Ser. No. 35,022 in particular proposes a method which replenishes the electrical conductive particles from a developing apparatus to make up for insufficiency of the electrical conductive particles.

When the electrical conductive particles are consumed at a high rate and it is desired to supply the electrical conductive particles at a high rate from the developing apparatus, it is sufficient to mix the electrical conductive particles at a higher ratio with a toner, but the higher ratio of the electrical conductive particles poses a problem that it makes triboelectricity of the toner unstable and causes defective image transfer.

Furthermore, the electrical conductive particles are supplied at a low rate and apt to be insufficient in a charging portion of the developing apparatus such as a contacting developing apparatus in particular which produces electric fields having low electric field intensities for development as in the contacting developing method.

SUMMARY OF THE INVENTION

An object of the present invention is to provide an image forming apparatus which is capable of supplying a sufficient amount of electrical conductive particles from a developing apparatus to an image bearing body.

Another object of the present invention is to provide an image forming apparatus which is capable of supplying the electrical conductive particles to the image bearing body in a non-image forming.

Still another object of the present invention is to provide an image forming apparatus comprising:

an image bearing body;

charging means for charging the image bearing body;

electrostatic image forming means forming an electrostatic image on the image bearing body charged by the charging means;

developing means developing the electrostatic image on the image bearing body with a developer containing a toner;

the developer being mixed with charging accelerating particles which frictionally charges the image bearing body at a polarity reverse to that of the toner and accelerates charging of the image bearing body by the charging means, and the developing means having a developing rotating body which bears the developer containing the charging accelerating particles; and electric field forming means for forming an electric field between the image bearing body and the developing rotating body to supply the charging accelerating particles to the image bearing body in the non-image forming.

Further objects of the present invention will be apparent from the following description made with reference to the accompanying drawings.

DETAILED DESCRIPTION OF THE PREFERRED EMBODIMENTS

Figure 1:
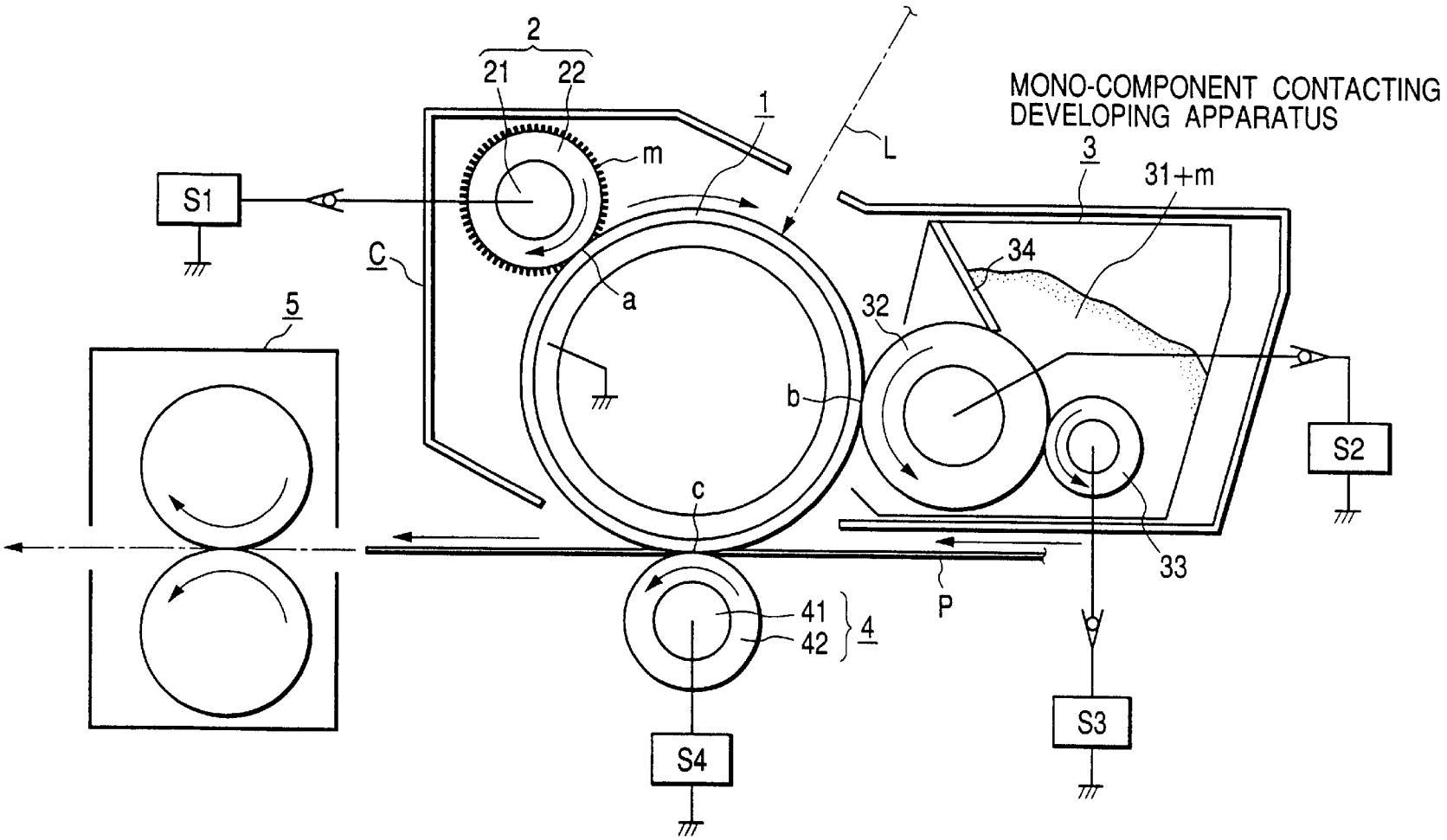
FIG. 1 is a schematic diagram showing a configuration of a first embodiment of the image forming apparatus according to the present invention.

<First Embodiment> (FIG. 1)

FIG. 1 is a schematic diagram showing an outline of a configuration of the first embodiment of the image forming apparatus according to the present invention.

The image forming apparatus preferred as the first embodiment is a cleanerless process cartridge type laser printer which utilizes an electronic photograph transfer process, contacting charging and reversal developing.

The image forming apparatus preferred as the first embodiment is characterized in that it performs injection charging with electrically conductive charging accelerating particles which accelerate charging interposed at least in a charging nip portion which is formed as nip portion between a contacting charging member and an image bearing body, that it adopts a contacting developing apparatus as developing means, that it supplies the charging (charge) accelerating particles from the contacting developing apparatus to a contacting charging nip member by way of a surface of a photosensitive body, and that bias applied to a developing roller and a feed roller in the contacting developing apparatus in image forming are made different from those applied in non-image forming, thereby supplying substantially only the charging accelerating particles in non-image forming while preventing development with a developer.

(1) Outline of Overall Configuration of Printer Preferred as First Embodiment

[Image Bearing Body]

A reference numeral 1 represents a rotating drum type photosensitive body for electronic photographs which is used as an image bearing body (body to be charged). The printer preferred as the first embodiment uses the reversal developing and a negative photosensitive body as the photosensitive body 1. The photosensitive body 1 used in the first embodiment is an OPC photosensitive body having a diameter of 30 mm and driven to rotate clockwise as indicated by an arrow at a peripheral velocity of 94 mm/sec.

[Charging]

A reference numeral 2 designates an electrical conductive elastic roller (charging roller) which is disposed as a flexible contacting charging member kept in contact with the photosensitive body 1 under a predetermined pressure. A reference symbol a denotes a charging nip portion which is formed as a nip portion between the photosensitive body 1 and the charging roller 2. Charging accelerating particles m are preliminarily coated and borne on an outer circumferential surface of the charging roller 2, whereby the charging accelerating particles m are present in the charging nip portion a.

In the first embodiment, the charging roller 2 is driven in the charging nip portion a to rotate at a peripheral velocity of 100% in a counter direction to a rotating direction of the photosensitive body 1 and is kept in contact with a surface of the photosensitive body 1 while reserving a difference in its velocity.

A predetermined bias is applied to the charging roller 2 from a charging bias power source S1. Accordingly, an outer circumferential surface of the rotating photosensitive body 1 is uniformly treated for contacting charging at predetermined polarity and potential by an injection charging mechanism.

In the first embodiment, the charging bias power source S1 applies a charging bias to the charging roller 2 so that the outer circumferential surface of the photosensitive body 1 is uniformly charged at about −700 V.

The charging roller 2, the charging accelerating particles m and the injection charging will be described in detail separately.

[Exposure]

With a laser beam output from a laser beam scanner (not shown) which comprises a laser diode, a polygonal mirror and the like, a scanning exposure L is conducted on the surface of the rotating photosensitive body 1 which is to be subjected to the charging treatment. The laser beam output from the laser beam scanner is modulated in its intensity in correspondence to time series electric digital pixel signals of target image data and the scanning exposure L forms an electrostatic latent image which corresponds to the target image data on the outer circumferential surface of the rotating photosensitive body 1.

In the first embodiment which uses the reversal developing, areas of the outer circumferential surface of the rotating photosensitive body 1 which are exposed and not exposed by the scanning exposure L with the laser beam are an image area and a non-image area respectively.

[Development]

A reference numeral 3 represents a developing apparatus. The developing apparatus 3 used in the first embodiment is a reversal contacting developing apparatus using a developer 31 which is a negatively chargeable non-magnetic mono-component insulating developer having an average particle diameter of 6 $\mu$m.

The developing apparatus 3 allows the developer (toner) to adhere to the exposed area, thereby developing the electrostatic latent image formed on the outer circumferential surface of the rotating photosensitive body 1 as a reversed developer image (toner image).

The charging accelerating particles m are mixed with the developer 31 at a ratio of 0.5 parts by weight relative to 100 parts by weight of the developer.

A reference numeral 32 represents an elastic developing roller having a diameter of 16 mm adopted as a developing member (developer bearing-carrying member). The developing roller 32 used in the first embodiment is composed of an aluminium sleeve base coated with a rubber which has electric resistance adjusted to a medium value by dispersing carbon therein. When the developing roller 32 was brought into contact with an aluminium drum to set it in a condition which was the same as a condition of its practical use, an electric resistance value was measured as $1\times10^5$ Ω between the aluminium drum and the aluminium sleeve base at an application voltage of 100 V.

In a condition where the developer 31 is coated over the developing roller 32 and a contacting nip is fixed at a width of 2 mm on the surface of the photosensitive body 1, the developing roller 32 is rotated at a peripheral velocity of 180% in the same direction as the photosensitive body 1 in a contacting section (developing section) b which is in contact with the photosensitive body 1 and a developing bias is applied from a developing bias power source S2 to the developing roller 32.

The developer 31 in the contacting developing apparatus 3 is frictionally charged by slide contact with the elastic blade 34, thereby having electric charges. The developer 31 is fed to the developing roller 32 by a feed roller 33. The feed roller 33 rotates at a peripheral velocity of 90% in a direction reverse (counter) to the rotating direction of the developing roller 32.

In an image forming, development is carried out between the developing roller 32 and the photosensitive body 1 by applying a DC voltage of −420 V as the developing bias from the developing bias power source S2 to the developing roller 32. Furthermore, a bias power source S3 applies a voltage of −500 V to the feed roller 33 to positively feed the developer 31 from the feed roller 33 to the developing roller 32 and return the charging accelerating particles m from the developing roller 32 to the feed roller 33.

In a non-image forming, the bias power source S3 applies a voltage of +350 V to the feed roller 33 to return the developer 31 from the developing roller 32 to the feed roller 33 and simultaneously feed the charging accelerating particles m positively to the developing roller 32. Furthermore, an AV voltage which has a DC component of 0 V, a peak-to-peak voltage of 400 V and a frequency of 1.5 kHz is applied to the developing roller 32 to oscillate the charging accelerating particles m and the developer 31, thereby separating them from each other. Since the charging accelerating particles m have a positive charge polarity which is reverse to that of the developer 31, these particles are fed from the contacting developing apparatus 3 to the surface of the photosensitive body 1.

[Transfer]

A reference numeral 4 represents a transfer roller having medium resistance which is provided as contacting transfer means and kept in contact with the photosensitive body 1 under a predetermined pressure to form a transfer section c. A transfer material P is fed as a recording medium into the transfer section c at a predetermined timing from a paper feeder (not shown) and a predetermined transfer bias is applied to the transfer roller 4 from a transfer bias power source S4, whereby a developer image is consecutively transferred from the photosensitive body 1 to a surface of the transfer material P which is fed into the transfer section c.

The transfer roller 4 used in the first embodiment is composed of a core metal 41 which has a medium resistance elastic layer 42 formed thereover and a resistance value of $5\times10^8$ Ω, and a DC voltage of +3000 V is applied to the core metal 41 for image transfer. The developer image formed and borne on the surface of the photosensitive body 1 is consecutively transferred by an electrostatic force and a pressing force while the transfer material P which is introduced into the transfer section c is sandwiched and carried by the transfer section c.

[Fixing]

A reference numeral 5 represents a fixing apparatus of a thermal fixing method or the like. The transfer material P which has been fed into the transfer section c and to which the developer images on the photosensitive body 1 have been transferred is separated from the surface of the rotating photosensitive body 1, introduced into the fixing apparatus 5 for fixing of the developer image and discharged as a print or copy.

[Cartridge]

The printer preferred as the first embodiment is configured as a cartridge C which comprises three process apparatuses of the photosensitive body 1, the charging roller 2 and the developing apparatus 3, and is detachably attachable as a whole to a main body of the printer. A combination of the process apparatuses mentioned above configured as the cartridge is not limitative.

[Operating Sequence of Printer]

Figure 2:
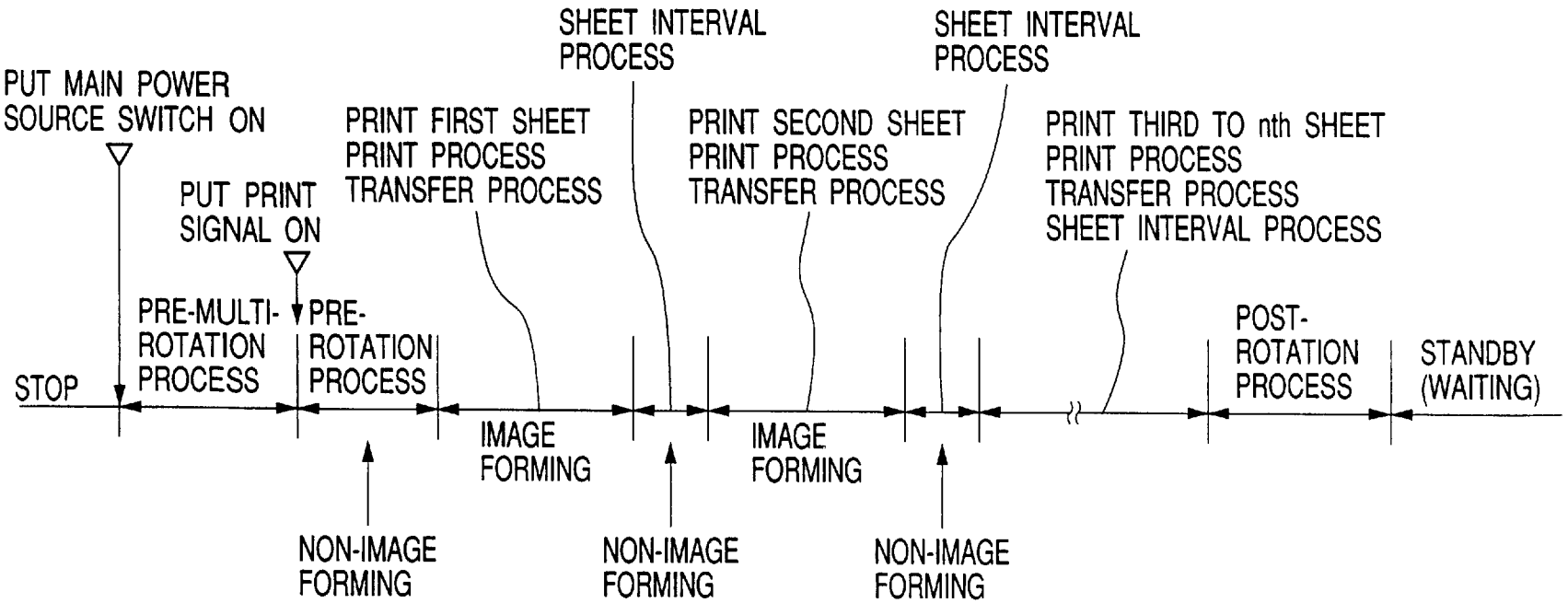
FIG. 2 is a diagram showing an operating sequence of the image forming apparatus according to the present invention.

FIG. 2 is a diagram showing an operating sequence of the printer described above.

AA. Pre-multi-rotation Process:

This is a starting period of the printer (a period to start or warm up the printer). A main power source switch is turned on to drive a main motor of the printer, thereby rotating the photosensitive body 1 and setting predetermined process apparatuses ready for operation.

BB. Pre-rotation Process:

This is a period to execute pre-print operations. The pre-rotation process is executed successively to the pre-multi-rotation process when a print signal is input at the pre-multi-rotation process. When the print signal is not input, upon completion of the pre-multi-rotation process, the driving of the main motor is temporally intercepted to stop the rotational driving of the photosensitive body drum and the printer is kept in a standby condition until the print signal is input. The pre-rotation process is executed when the print signal is input.

CC. Print Process (Image Forming Process or Image Creating Process):

Upon completion of the predetermined pre-rotation process, the printer successively executes a process to create an image on the rotating photosensitive body 1, transfers a developer image formed on the surface of the rotating photosensitive body to the transfer material P and fixes the developer image with the fixing apparatus 5, and prints out a copy.

In a successive print mode, the print process is executed repeatedly in a number n which is set corresponding to the number of required copies.

DD. Sheet Interval Process:

This is a period of the successive print mode wherein a transfer material P is not fed to the transfer section c after a tailing end of the first transfer material P has passed through the transfer section c until a leading end of the next transfer material P reaches the transfer section c.

EE. Post-rotation Process:

This is a period to continue the driving of the main motor for a certain time even after completing the print process for a last nth copy, thereby rotationally driving the photosensitive body 1 and executing predetermined post operations.

FF. Standby:

After completing the predetermined post-rotation process, the driving of the main motor is stopped, whereby the rotational driving of the photosensitive body 1 is stopped and the printer is set in a standby condition until the next print start signal is input.

When the printer is set to print out only one sheet, the printer is placed in the standby condition through the post-rotation process after completing printout of the sheet.

When the print start signal is input in the standby condition, the printer proceeds to the pre-rotation process.

The print process CC corresponds to the time for an image forming, whereas the pre-multi-rotation process AA, the pre-rotation process BB, the sheet interval process DD and the post-rotation process EE correspond to the time for a non-image forming.

At the pre-multi rotation process AA and the post-rotation process EE, a cleaning bias which has the same polarity as the charged polarity of the developer 31 is applied to the transfer roller 4 to clean the transfer roller 4 by transferring the developer adhering as a contaminant to the transfer roller 4 to the surface of the photosensitive body.

(2) Charging Roller 2

The charging roller 2 which is used as a flexible contacting charging nip member in the first embodiment is composed by forming a medium resistance layer 22 of a rubber or a foamed material over the core metal 21.

The medium resistance layer 22 is treated with a resin (urethane in the first embodiment), electrical conductive particles (for example, carbon black), a sulfurating agent or a foaming agent and formed in a form of a roller over the core metal 21. The surface of the medium resistance layer is polished.

It is important that the charging roller 2 which is used as the contacting charging nip member functions as an electrode. That is, the charging roller 2 must have elasticity to assure a sufficient contact condition with the body to be charged and resistance low enough to charge the body to be charged which is moving. On the other hand, the charging roller 2 must prevent voltage leak when the body to be charged has defective locations such as pinholes which have low dielectric strength or low voltage endurance. When a photosensitive body for electronic photographs is used as the body to be charged, it is desirable that the charging roller 2 has resistance of $10^4$ to $10^7$ Ω so that it exhibits a sufficient charging capability and securely prevents voltage leak.

It is desirable that the charging roller 2 has microscopic concavities and convexities on its surface so that it can sustain the charging accelerating particles m.

It is preferable that the charging roller 2 has hardness within a range of 25 to 50 degrees in asker C hardness since too low hardness makes the charging roller 2 unstable in its shape, thereby lowering its contact property with the body to be charged and too high hardness not only makes it impossible to reserve the charging nip portion a between the charging roller 2 and the body to be charged but also lowers a microscopic contact property with a surface of the body to be charged.

As materials for the charging roller 2, there can be mentioned not only elastic foamed materials but also elastic rubber materials such as EPDM, urethane, NBR, silicone rubber and IR which contain conductive substances such as carbon black, metallic oxides or the like dispersed therein to adjust resistance or are in foamed conditions. It is possible to adjust resistance not by dispersing the conductive substance but by using materials which permit ion conduction.

Against the elasticity of the material, the charging roller 2 is kept in contact under a predetermined pressure with the photosensitive body 1 which is the body to be charged so as to form the charging nip portion a several millimeters wide in the first embodiment.

A resistance value of the charging roller 2 was determined as described below. The photosensitive body 1 of the printer was replaced with an aluminium drum. Then, a current was measured to calculate the resistance value of the charging roller 2 while applying a voltage of 100 V across the aluminium drum and the core metal 21 of the charging roller 2.

The resistance value thus determined of the charging roller 2 used in the first embodiment was $5\times10^6$ Ω. The resistance was measured at a temperature of 25° C. and a humidity of 60%. The measuring conditions in the first embodiment remained unchanged in other embodiments.

(3) Charging Accelerating Particles m

In the first embodiment, conductive zinc oxide particles which had specific resistance of $10^7$ Ω·cm and an average particle diameter of 2.5 μm were used as the charging accelerating particles m which were to be preliminarily coated on the outer circumferential surface of the charging roller 2 and added to the developer 31 in the contacting developing apparatus 3.

The charging accelerating particles may exist not only in a condition of primary particles but also in a condition of agglomerated secondary particles with no problem. The charging accelerating particles may be in any agglomerated condition or no importance is placed on the agglomerated condition so far as the particles can perform their original function.

When a cohesive body is constituted by the particles, the particle diameter was defined as an average particle diameter of the cohesive body. The particle diameter was determined by sampling 100 or more particles while observing them through an optical or electron microscope, calculating a volumetric particle size distribution using a horizontal maximum chord length and adopting an average particle diameter at 50% of the volumetric particle size distribution.

A charging property was degraded when the charging accelerating particles m had a resistance value of $10^{12}$ Ω·cm or higher. Therefore, the charging accelerating particles must have a resistance value of $10^{12}$ Ω·cm or lower, more preferably $10^{10}$ Ω·cm or lower. Used in the first embodiment were charging accelerating particles which had a resistance value of $1\times10^7$ Ω·cm.

Resistance was measured by a pellet method and specific resistance was determined by normalization. Speaking concretely, approximately 0.5 g of a powder sample was put into a cylinder having a bottom surface of 2.26 $cm^2$ and a resistance value was measured while applying a pressure of 15 kg and a voltage of 100 V across upper and lower electrodes, whereafter specific resistance was determined by normalizing the resistance value.

It is preferable that the charging accelerating particles m are white or nearly transparent and non-magnetic so as not to hinder exposure of a latent image. Considering the fact that the charging accelerating particles are partially transferred from the photosensitive body to the transfer material P, it is desirable that the charging accelerating particles are colorless or white. Also, the charging accelerating particles which had a particle diameter more than ½ or so with respect to the particle diameter of the developer 31 might hinder exposure of an image. It is therefore desirable that the charging accelerating particles m have a particle diameter smaller than ½ of the particle diameter of the developer 31. It is considered that a lower limit of the particle diameter of the charging accelerating particles which are obtained as stable particles lies at 10 nm.

Usable as materials of the charging accelerating particles m are not only zinc oxide which is used in the first embodiment but also various kinds of electrical conductive particles such as conductive inorganic particles of other metallic oxides such as alumina, mixtures of the metallic oxides with organic substances and the mixtures subjected to surface treatments.

(4) Injection Charging

1) Even when high frictional resistance of the charging roller 2 makes it difficult to keep the charging roller 2 in contact with the photosensitive body 1 while reserving a difference in velocities thereof, the charging accelerating particles m in the charging nip portion a interposed between the photosensitive body 1 and the charging roller 2 which are the image bearing body and the contacting charging member respectively exhibit a lubricating effect which makes it possible not only to keep the charging roller 2 in contact with the surface of the photosensitive body 1 while reasonably and easily reserving a difference between the velocities of the photosensitive body and the charging roller but also to keep the charging roller 2 in close contact with the surface of the photosensitive body 1 by way of the particles m, thereby bringing the particles into contact with the surface of the photosensitive body 1 at a higher frequency.

By reserving a sufficient difference between the velocities of the charging roller 2 and the photosensitive body 1, it is possible to remarkably increase occasions to bring the charging accelerating particles m into contact with the photosensitive body 1 in the nip portion a between the charging roller 2 and the photosensitive body 1 and enhance a contacting property, whereby the charging accelerating particles m present in the charging nip portion a between the charging roller 2 and the photosensitive body 1 are brought into slide contact with the surface of the photosensitive body 1 with no gap, electric charges can be injected directly into the photosensitive body 1 and interposed charging accelerating particles m allow an injection charging mechanism to govern the contacting charging of the photosensitive body 1 by the charging roller 2.

To reserve a difference between the velocities, the charging roller 2 is driven to rotate at a velocity different from that of the photosensitive body 1. It is desirable to rotate the charging roller 2 in a direction reverse to a moving direction of the surface of the photosensitive body 1 so that the developer which is brought to the charging nip portion a and remains on the photosensitive body 1 after image transfer is recovered temporarily to the charging roller 2. That is, the reverse rotation of the charging roller 2 makes it possible to charge the photosensitive body 1 with the remaining developer once separated therefrom so that the injection charging is preferential.

Accordingly, the injection charging provides a high charging efficiency which is unavailable with the conventional roller charging or the like and can charge the photosensitive body 1 to a potential nearly equal to a voltage applied to the charging roller 2.

Accordingly, the injection charging allows a voltage which is nearly equal to a charged potential required for the photosensitive body 1 to be used sufficiently as a charging application bias for the charging roller 2 even when it is used as the contacting charging member and makes it possible to obtain a stable and safe contacting charging method or apparatus which does not use a discharging phenomenon.

When a lying amount of the charging accelerating particles m present in the charging nip portion n interposed between the photosensitive body 1 and the charging roller 2 which are the image bearing body and the contacting charging member respectively is too small, a lubricating effect of the particles m can not be realized sufficiently and it is difficult to rotate the charging roller 2 at a velocity different from a rotating velocity of the photosensitive body 1 because of high friction between the charging roller 2 and the photosensitive body 1. That is, too small an amount of the particles m constitutes a cause for excessive driving torque, whereby surfaces of the charging roller 2 and the photosensitive body 1 are cut off when they are rotated forcibly. Furthermore, the particles m may not exhibit the effect to increase the occasions of the contact with the photosensitive body 1 or enhance a sufficient charging property. On the other hand, too large the lying amount allows the charging accelerating particles to drop in a remarkably increased amount from the charging roller 2, thereby producing adverse influences on image transfer.

It is experimentally desirable make the lying amount be $10^3/mm^2$ or larger. The lying amount smaller than $10^3/mm^2$ does not allow the charging accelerating particles m to sufficiently exhibit the lubricating effect and the effect to increase the occasions of contact, thereby resulting in lowering of the charging property.

It is more desirable to make the lying amount be $10^3$ to $5\times10^5/mm^2$. The lying amount exceeding $5\times10^5/mm^2$ remarkably increases the number of charging accelerating particles m which drop to the photosensitive body 1, thereby resulting in insufficient exposure of the photosensitive body 1 regardless of transmittance of the particles themselves. The lying amount smaller than $5\times10^5/mm^2$ allows a small number of the particles to drop, thereby enabling to suppress the adverse influence. Judging from the fact that existing amount of the particles which dropped to the photosensitive body 1 was measured as $10^2$ to $10^5/mm^2$ within the lying amount, it is desirable to make the existing amount be $10^5/mm^2$ or smaller so as not to produce the adverse influence on image transfer.

Description will be made of a method to measure the lying amount and the existing amount on the photosensitive body 1. Though it is desirable to directly measure the lying amount in the charging nip portion n between the charging roller 2 and the photosensitive body 1, the present invention adopts, as the lying amount, an amount of the particles which existed on the charging roller 2 immediately before the charging roller 2 reached the charging nip portion a since most of the particles which existed on the photosensitive body 1 before it was brought into contact with the charging roller 2 were stripped by the charging roller 2 which came into contact while rotating in the counter direction. Speaking more concretely, the rotations of the photosensitive body 1 and the charging roller 2 were stopped in a condition where a charging bias was not applied, and the surfaces of the photosensitive body 1 and the charging roller 2 were photographed with a video microscope (OVM 1000 N manufactured by OLYMPUS) and a digital still recorder (SR-3100 manufactured by DELTIS). The charging roller 2 was brought to abut against a slide glass plate in the same condition to bring the charging roller 2 to abut against the photosensitive body 1 and 10 or more locations of a contact surface of the charging roller 2 were photographed with the video microscope from behind the slide glass plate using an objective lens having a magnification of ×1000. To separate individual particles into areas from digital images thus obtained, the images were binarized with a certain threshold value and areas at which the particles existed were measured with an image processing software. The existing amount on the photosensitive body 1 was measured also by photographing the surface of the photosensitive body 1 with the video microscope and processing images by the image processing software.

2) The cleanerless image forming apparatus allows the developer remaining on the surface of the photosensitive body 1 after the image transfer to be carried into the charging nip portion a which is formed a nip portion between the photosensitive body 1 and the charging roller 2 as the photosensitive body 1 rotates.

When the charging roller 2 is kept in contact with the photosensitive body 1 while reserving a difference between velocities in the cleanerless image forming apparatus, it disturbs and breaks patterns of the developer remaining after the image transfer, thereby preventing preceding image patterns from producing ghost at a halftone.

3) The developer remaining after the image transfer which is carried into the charging nip portion a adheres to and mixes with the charging roller 2. Since the developer is an insulating material, the developer remaining after the image transfer which adheres to and mixes with the charging roller 2 conventionally constituted a cause for improper charging of the photosensitive body 1.

Even in such a case, however, the charging accelerating particles m which exist in the charging nip portion a interposed between the photosensitive body 1 and the charging roller 2 assures the close contact and contact resistance of the charging roller 2 to the photosensitive body 1, thereby making it possible to maintain stable ozoneless direct charging with a low application voltage for a long time and a uniform charging property though the developer remaining after the image transfer contaminates the charging roller 2.

4) The developer remaining after the image transfer which has adhered to and mixed with the charging roller 2 is gradually discharged from the charging roller 2 to the photosensitive body 1, carried to the developing section b as the photosensitive body 1 rotates and cleaned (recovered) in the developing apparatus 3 simultaneously with development (toner recycle).

In this case, the charging accelerating particles m which are borne on the charging roller 2 function to weaken adhering forces of the charging roller 2 and the developer remaining after the image transfer which had adhered to and mixed with the charging roller 2, thereby enhancing an efficiency to discharge the developer to the photosensitive body 1.

The cleaning simultaneous with the development is performed to recover the toner remaining on the photosensitive body 1 after the image transfer with a fogging removing bias, i.e., a fogging removing potential difference Vback which is a difference between a DC voltage applied to the developing apparatus and a potential on the surface of the photosensitive body at a developing process of a successive image transfer stage where the photosensitive body is charged successively and exposed to form a latent image and develop the latent image. In a printer which uses the reversal developing like the printer according to the present embodiment, the cleaning simultaneous with the development is performed by functions of an electric field which recovers the toner from a dark potential of the photosensitive body into the developing sleeve and an electric field which allows the toner to adhere from the developing sleeve to a bright potential of the photosensitive body.

5) Furthermore, the charging accelerating particles m which are substantially borne and sustained by the surface of the photosensitive body 1 provide an effect to transfer the developer at a higher efficiency from the photosensitive body 1 to the transfer material P.

(5) Supplying Charging Accelerating Particles m from Contacting Developing Apparatus 3 to Charging Nip Portion A Even when the charging accelerating particles m are set in a sufficient amount in the charging nip portion a which is the nip portion between the photosensitive body 1 and the charging roller 2 or when the charging accelerating particles m are preliminarily coated in a sufficient amount over the charging roller 2, the charging accelerating particles m may be supplied at a lower rate, as the printer operates, from the charging nip portion a which is the nip portion between the photosensitive body 1 and the charging roller 2, thereby degrading the charging property.

In the first embodiment, the charging accelerating particles m are preliminarily mixed with the developer 31 accommodated in the contacting developing apparatus 3 so that the charging accelerating particles m are supplied from the contacting developing apparatus 3 to the surface of the photosensitive body 1, and then not only to the charging nip portion a which is the nip portion between the photosensitive body 1 and the charging roller 2 but also to the charging roller 2 by way of the surface of the photosensitive body 1.

The charging accelerating particles m are supplied from the contacting developing apparatus 3 to the surface of the photosensitive body 1 at a timing of the non-image forming. In non-image forming, the printer applies bias in a sequence described below to supply the charging accelerating particles m from the contacting developing apparatus 3 to the surface of the photosensitive body 1.

1) In the contacting developing apparatus 3, the charging accelerating particles m are charged due to the slide contact with the developer 31 so as to have a positive polarity which is reverse to that of the developer 31.

Since, in image forming, a voltage of −500 V is applied to the feed roller 33, the developer 31 is supplied positively to the developing roller 32 due to a difference between potentials of the feed roller 33 and the developing roller 32.

In contrast, the charging accelerating particles m are returned to the feed roller 33.

In image forming, the charging accelerating particles m are returned from the developing roller 32 to the feed roller 33 using a DC voltage of −420 V as a developing bias applied to the developing roller 32, the charging accelerating particles exist only in a small amount on the developing roller and, since a potential contrast which generates a force to lead the charging accelerating particles to the photosensitive body is as low as 280 V (700−420=280 V), most of the charging accelerating particles which have low triboelectricity are defeated by an adhesive force to the developing roller and not supplied to the photosensitive body.

Accordingly, the charging accelerating particles produce no adverse influence on the image transfer.

Furthermore, the charging accelerating particles m exist only in a small amount on the developing roller 32, whereby the developing bias is not injected into the surface of the photosensitive body 1 from the developing roller 32 by way of the charging accelerating particles m.

2) Since, in non-image forming, a voltage of +350 V is applied to the feed roller 33 the developer 31 is returned from the developing roller 32 to the feed roller 33 and the charging accelerating particles m are positively supplied to the developing roller 32.

In non-image forming, an AC voltage which has a peak-to-peak voltage of 400 V and a frequency of 1.5 kHz is applied to the developing roller 32.

Furthermore, the photosensitive body is charged to −700 V.

Accordingly, the potential contrast which generates the force to lead the charging accelerating particles to the photosensitive body is as high as 700 V (700−0=700 V), whereby the charging accelerating particles are supplied from the developing roller to the photosensitive body.

Since the AC voltage is applied, the toner can easily separate from the charging accelerating particles, thereby enhancing a capability to supply the charging accelerating particles to the photosensitive body.

Since the developer 31 is returned from the developing roller 32 to the feed roller 33 in that case, the developer 31 is scarcely supplied to the photosensitive body 1. In contrast, the charging accelerating particles m which are supplied abundantly to the developing roller 32 can be fed without scarcity to the surface of the photosensitive body 1.

The charging accelerating particles m which have been supplied and adhered to the surface of the photosensitive body 1 in the developing section b and mixed with the developer 31 in the contacting developing apparatus 3 are carried into the charging nip portion a by way of the transfer section c as the photosensitive body 1 rotates, thereby being automatically fed to the charging nip portion a and the charging roller 2 to maintain a favorable charging property.

The operating sequence to apply the bias as described above is controlled by a control circuit (not shown).

In the present invention, the non-image forming is at least one of the non-image forming shown in FIG. 2 or at least a predetermined time of the non-image forming.

Since the printer has the bias application sequence to supply the charging accelerating particles m from the contacting developing apparatus 3 to the surface of the photosensitive body 1 by way of the developing roller 32 and simultaneously return the developer 31 from the developing roller 32 to the contacting developing apparatus 3 in non-image forming as described above, the printer is capable of supplying the charging accelerating particles m sufficiently to the charging nip portion a without the adverse influence on an image, thereby providing a stable charging property and a favorable image.

Furthermore, the printer does not damage an image by supplying the developer 31 in an excessive amount to the surface of the photosensitive body 1.

(6) Comparative Example

The present embodiments and the comparative example will be described below.

To verify the effect of the bias which are applied to supply the charging accelerating particles in non-image forming according to the first embodiment, charging properties were compared as described below:

In a condition where DC components and AC components of the bias applied to the developing roller 32 and the feed roller 33 in the contacting developing apparatus 3 are set at various levels as listed in Table 1, the photosensitive body 1 was rotated idly for 10 turns so that the charging accelerating particles m are fed to and coated over the charging roller 2, copies having blank copy (solid) white images were printed out and charging properties were compared by measuring fogging amounts on the images.

TC-6DS manufactured by Tokyo Denshoku Co. was used to measure the fogging amounts. A fogging amount on an image was defined as a difference between a fogging amount measured on a reference sheet on which no image was printed out and a fogging amount measured on a sheet on which an image was printed out (which had passed through the charging nip portion).

Charging properties were adopted as an evaluation standard since it was difficult to measure feeding rates of the charging accelerating particles.

The measurements were started in a condition where the charging accelerating particles m were not adhering to the charging roller 2.

A developing bias of DC −420 V was applied to print out all copies which had the monochromatic white images.

Table 1 shows measured results of the applied bias and the fogging amounts.

TABLE 1

| AC peak-to-peak voltage → | | 0 V | 200 V | 400 V | 600 V |
|---|---|---|---|---|---|
| | | Bias −550 V/h applied to feed roller | | | |
| DC component | 0 V | 1.8 | 1.3 | 0.7 | 0.7 |
| DC component | −420 V | 2.2 | 1.7 | 0.8 | 0.7 |
| DC component | −600 V | 2.7 | 2.2 | 1.5 | 1.2 |
| | | Bias +350 V/h applied to feed roller | | | |
| DC component | 0 V | 1.5 | 1.0 | 0.5 | 0.5 |
| DC component | −420 V | 2.0 | 1.5 | 0.5 (First embodiment) | 0.5 |
| DC component | −600 V | 2.5 | 2.0 | 1.5 | 1.0 |

As understood from the results shown in Table 1, the first embodiment provides a favorable charging property.

A bias applied in image forming and a bias applied in non-image forming which were not different from each other unlike those used in the first embodiment posed problems described below. An enhanced AC peak-to-peak voltage allowed a developing bias to be injected into the surface of the photosensitive body 1 in the developing section b, thereby producing fogging on an image, whereas a smaller (positive) DC component of the developing bias improved a charging property, but unbalanced developing contrast, thereby degrading a developing property.

In contrast, the first embodiment is free from such undesirable phenomena.

As understood from the foregoing description, the first embodiment uses the DC bias as the developing bias applied to the developing roller 32 in image forming, applies the AC component at the non-image forming stage, and adopts different bias to be applied to the feed roller 33 in image forming and non-image forming, thereby being capable of preventing fogging from being produced on an image while feeding the charging accelerating particles.

Figure 3:
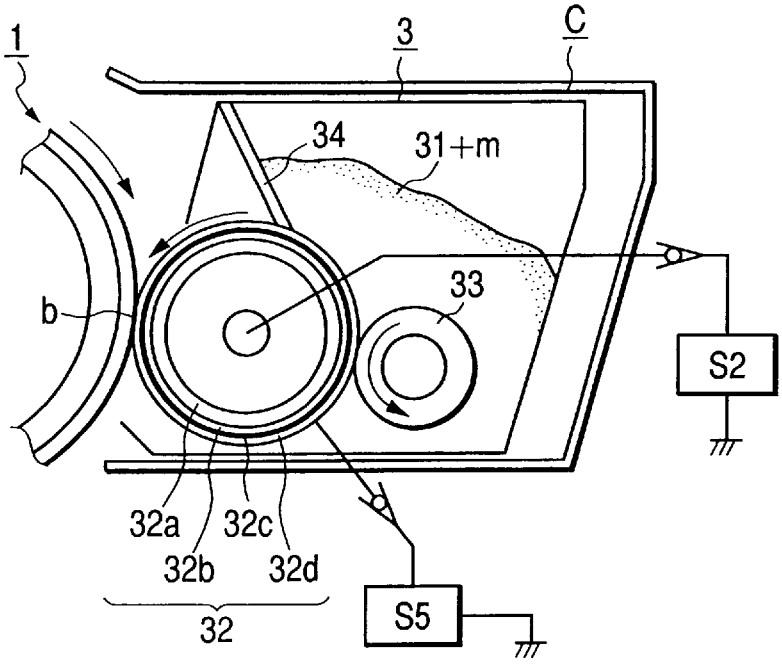
FIG. 3 is a partial diagram showing main portion of a second embodiment of the image forming apparatus according to the present invention.

<Second Embodiment> (FIG. 3)

FIG. 3 is a partial diagram showing main members of a printer preferred as the second embodiment.

The printer preferred as the second embodiment is characterized in that electrical conductive layers are formed in the elastic developing roller 32 disposed in the contacting developing apparatus 3 of the printer preferred as the first embodiment (FIG. 1) and that the charging accelerating particles are fed to the surface of the photosensitive body by applying a bias to the electrical conductive layers in non-image forming.

Other members of the second embodiment are substantially the same as those of the first embodiment and not described once again.

The contacting developing roller 32 used in the second embodiment is composed of a rubber layer 32*b* which is coated over an aluminium sleeve base 32*a* and has an electric resistance adjusted to a medium value by dispersing carbon therein, an electrical conductive layer 32*c* which is formed by covering the rubber layer 32*b* with a thin aluminium film, and a rubber layer 32*d* having medium resistance which is coated over the electrical conductive layer 32*c*.

When the developing roller 32 was brought into contact with an aluminium drum to set it in a condition which was the same as a condition of its practical use, an electric resistance value as measured across the aluminium drum and the aluminium sleeve base was $1\times10^5$ Ω at an application voltage of 100 V.

An electric resistance value as measured across the thin aluminium layer used as the electrical conductive layer 32*c* disposed between the rubber layers 32*b* and 32*d* having the medium resistance and the aluminium drum as $1\times10^3$ Ω at the application voltage of 100 V.

The second embodiment is characterized in that the electrical conductive layer 32*c* is formed between the rubber layers 32*b* and 32*d* having the medium resistance in the elastic developing roller 32, and that a charging accelerating particle feeding bias is applied from a bias power source S5 to the electrical conductive layer 32*c* to feed the charging accelerating particles m to the surface of the photosensitive body 1 in non-image forming.

Accordingly, the second embodiment sets a high resistance value between the contacting developing roller 32 and the photosensitive body 1 and suppresses injection of the developing bias power source S2 applied from the developing bias to the developing roller 32 into the surface of the photosensitive body 1 in image forming, but sets a low resistance value between the contacting developing roller 32 and the photosensitive body 1 in non-image forming and keeps a narrow gap between the layer 32*c* to which the bias is applied to feed the charging accelerating particles to the developing roller 32 and the photosensitive body 1, thereby being capable of applying a bias having a high electric field to the charging accelerating particles and feeding a sufficient amount of the charging accelerating particles m to the surface of the photosensitive body 1 from the contacting developing apparatus 3.

Figure 4:
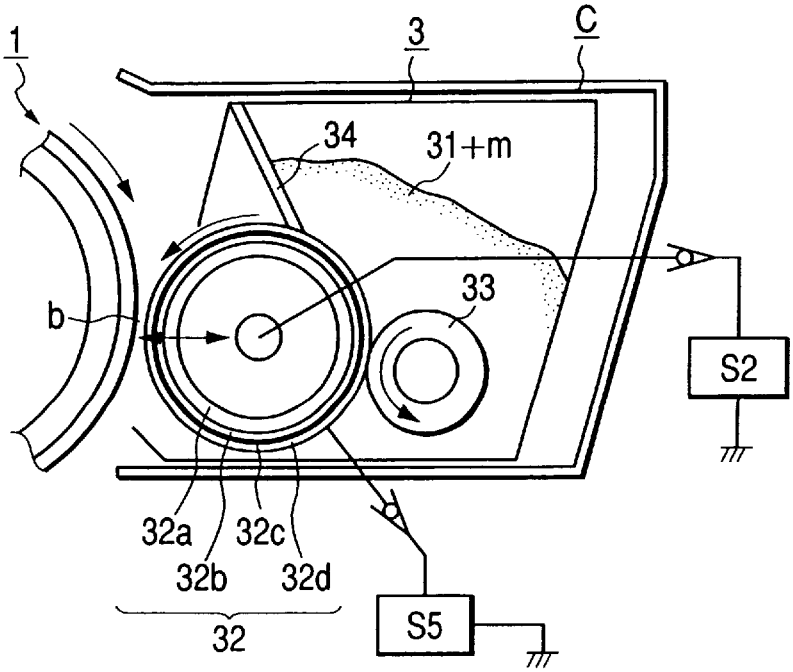
FIG. 4 is a partial diagram showing main members of a third embodiment of the image forming apparatus according to the present invention.

<Third Embodiment> (FIG. 4)

FIG. 4 is a partial diagram showing main members of a printer preferred as the third embodiment.

A printer preferred as the third embodiment is characterized in that the elastic developing roller 32 of the contacting developing apparatus 3 is set in a contactless condition where it is apart from the photosensitive body 1 in the non-image forming in the printer preferred as the second embodiment described above (FIG. 3) and that the charging accelerating particles m are fed from the contacting developing apparatus 3 to the photosensitive body 1 in this contactless condition.

By changing a distance to the photosensitive body 1, the contactless condition of the developing roller 32 can be switched to a contact condition where it is in contact with the photosensitive body 1. Speaking more concretely of the second embodiment, the developing apparatus 3 is disposed slidably toward and apart from the photosensitive body 1 and normally urged with an urging member (not shown) toward the photosensitive body 1 so that it is kept in contact with the photosensitive body 1 under a predetermined pressure. The developing roller 32 can be kept in a condition where it is apart for a predetermined distance from the photosensitive body 1 when the developing apparatus 3 is moved apart from the photosensitive body 1 with an electromagnetic solenoid against a function of the urging member.

Accordingly, the developing apparatus 3 keeps the developing roller 32 in the condition where it is in contact with the photosensitive body 1 under the predetermined pressure when the electromagnetic solenoid is deenergized or in the contactless condition where the developing roller 32 is apart for the predetermined distance from the photosensitive body 1 when the electromagnetic solenoid is energized. FIG. 4 shows the contactless condition where the developing roller 32 is kept apart for the predetermined distance from the photosensitive body 1.

When the developing roller 32 used in the third embodiment was brought into contact with an aluminium drum to set it in a condition which was the same as a condition of its practical use, an electric resistance value as measured across the aluminium drum and the aluminium sleeve base was $1\times10^5$ Ω at an application voltage of 100 V and an electric resistance value as measured across the thin aluminium layer which is used as the electrical conductive layer 32*c* disposed between the rubber layers 32*b* and 32*d* having the medium resistance and the aluminium drum was $1\times10^2$ Ω at the application voltage of 100 V.

Other members of the third embodiment are substantially the same as those of the second embodiment and not described once again.

The third embodiment is characterized in that the developing roller 32 is brought into contact with the photosensitive body 1 by deenergizing the electromagnetic solenoid in image forming (FIG. 3), and that a bias power source S5 applies a charging accelerating particle feeding bias to the electrical conductive layer 32*c* of the developing roller in non-image forming in a condition where the developing roller 32 is kept apart from the photosensitive body 1 as shown in FIG. 4 by energizing the electromagnetic solenoid, thereby allowing the charging accelerating particles m to be fed leapingly from the developing roller 32 to the surface of the photosensitive body 1.

Accordingly, the third embodiment allows no electric charge to be injected into the surface of the photosensitive body 1 even when a high charging accelerating particle feeding bias is applied from the bias power source S5 to the electrical conductive layer 32*c* of the developing roller 32 in non-image forming, thereby producing no influence on a next image transfer. Since the third embodiment applies the charging accelerating particle feeding bias from the bias power source S5 to the electrical conductive layer 32*c* of the developing roller 32 in non-image forming like the second embodiment, the third embodiment is capable of applying a feeding bias having a high electric field to the charging accelerating particles, thereby sufficiently feeding the charging accelerating particles m from the contacting developing apparatus 3 on the surface of the photosensitive body 1.

Figure 5:
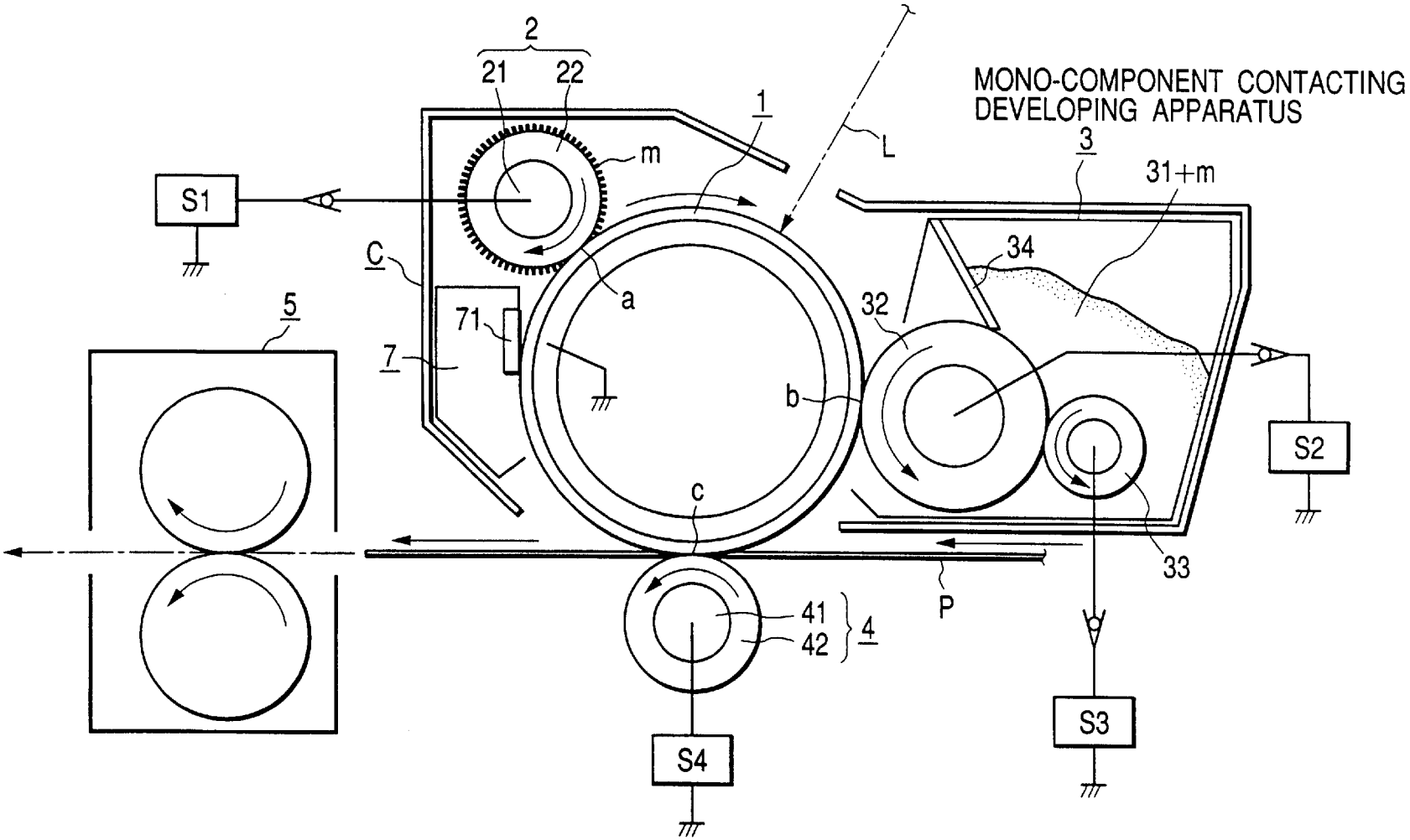
FIG. 5 is a schematic diagram showing a configuration of a fourth embodiment of the image forming apparatus according to the present invention.

<Fourth Embodiment> (FIG. 5)

A printer preferred as the fourth embodiment shown in FIG. 5 is the printer preferred as the first embodiment (in FIG. 1) which is equipped with a cleaning apparatus (cleaner) 7 disposed between the transfer section c and the charging nip portion a to clean the surface of the photosensitive body 1 by removing the developer remaining after the image transfer, sheet powder and the like. Other members of the fourth embodiment are substantially the same as those of the printer preferred as the first embodiment and not described once again.

The cleaning apparatus 7 adopted in the fourth embodiment uses a cleaning blade 71 which cleans the photosensitive body 1. The cleaning blade 71 is an elastic blade made of a urethane rubber and is pressed against the photosensitive body 1, thereby removing from the surface of the photosensitive body 1 most of the developer and sheet powder remaining on the surface of the photosensitive body 1 after the image transfer.

The fourth embodiment therefore allows, as compared with a cleanerless printer, remarkably small amounts of the developer and sheet powder remaining after the image transfer to shift to, mix in and adhere to the charging nip portion a, thereby providing more favorable charging property and a stable image quality.

Out of the developer, the sheet powder and the charging accelerating particle which remain on the surface of the photosensitive body 1 after the image transfer, the charging accelerating particles have a smallest particle diameter and are liable to pass through the cleaning apparatus 7 and brought to the charging nip portion a even when the cleaning apparatus 7 is disposed.

Accordingly, the charging accelerating particles m which have been mixed with the developer 31 in the developing apparatus 3, and supplied and adhered to the surface of the photosensitive body 1 in the developing section b are brought to the charging nip portion a by way of the transfer section c as the surface of the photosensitive body 1 rotates even when the cleaning apparatus 7 is disposed, thereby automatically fed to the charging nip portion a and the charging roller 2 to maintain a favorable charging property.

Furthermore, the charging accelerating particles m which adhere to contact portions of the cleaning blade 71 and the surface of the photosensitive body 1 serve to prevent the cleaning blade 71 from being turned over due to friction with the surface of the photosensitive body 1 and function to allow the photosensitive body 1 with a uniform rotating velocity. Accordingly, the fourth embodiment is capable of providing a favorable image.

The cleaning blade 71 may conventionally be turned over or the photosensitive body 1 may have an ununiform rotating velocity when the surface of the photosensitive body 1 has a low sliding property in the printer which is equipped with the cleaning apparatus 7 using the cleaning blade 71. In the fourth embodiment, the charging accelerating particles m adhere to the surface of the photosensitive body 1 and are present between the cleaning blade 71 and the photosensitive body 1. Accordingly, the fourth embodiment enhances the sliding property, thereby preventing the cleaning blade 71 from being turned over due to the friction with the photosensitive body 1 and making the photosensitive body 1 free from an ununiform rotating velocity.

Similarly, the charging accelerating particles m mixed with the developer 31 weaken a frictional force between the contacting developing apparatus 3 and the photosensitive body 1, thereby preventing the developing roller 32 and the photosensitive body 1 from being rotated at ununiform velocities due to sliding friction between these members. Accordingly, the fourth embodiment allows no image to be uneven due to ununiform rotating velocities, thereby providing a favorable image.

Figure 6:
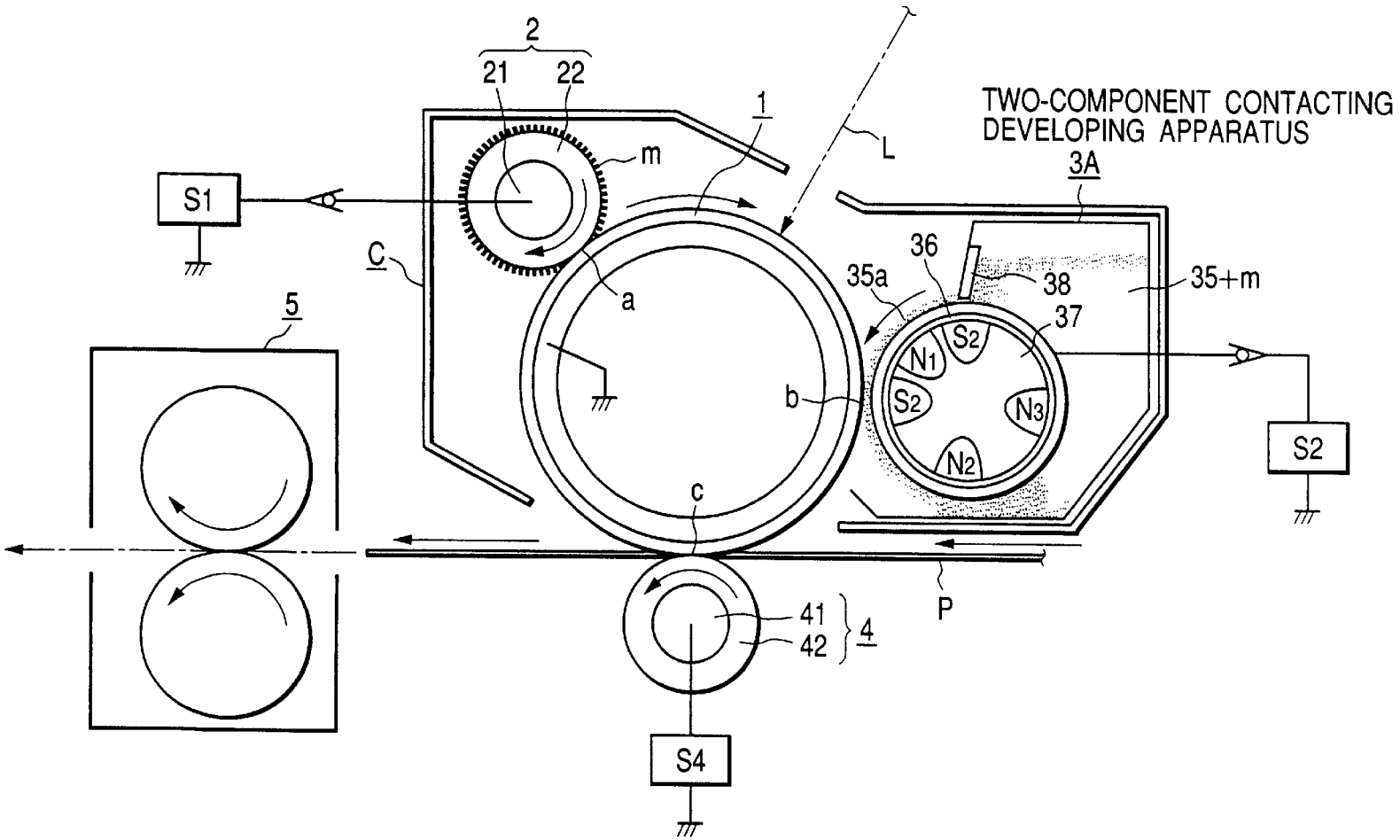
FIG. 6 is a schematic diagram showing a configuration of a fifth embodiment of the image forming apparatus according to the present invention.

<Fifth Embodiment> (FIG. 6)

A printer preferred as the fifth embodiment shown in FIG. 6 is the printer preferred as the first embodiment (FIG. 1) which uses a two-component contacting developing apparatus 3A in place of the developing apparatus 3. Other members of the fifth embodiment are substantially the same as those of the printer preferred as the first embodiment and not described once again.

The two-component contacting developing apparatus 3A adopted in the fifth embodiment uses a two-component developer 35 which is composed of a mixture consisting of toner particles and carrier particles made of ferrite having a particle diameter of 40 $\mu$m and configured as a two-component magnetic brush contacting developing apparatus which sustains the developer 35 as a magnetic brush layer 35*a* on a developer bearing-carrying member 36 with a magnetic force and carries the magnetic brush layer 35*a* to a developing section b, thereby bringing it into contact with the surface of the photosensitive body 1 and reversally developing an electrostatic image with the toner particles. The toner particles are the same as the developer 31 used in the first embodiment which is the negatively chargeable non-magnetic mono-component insulating developer having the average particle diameter of 7 $\mu$m. The toner particles are mixed at a ratio of 7% by weight with the carrier particles. The toner particles are charged due to slide friction with the carrier particles and have electric charges.

A reference numeral 36 represents a developing sleeve having a diameter of 16 mm which is used as the developer bearing-carrying member, a reference numeral 37 designates a magnet roll which is fixed as magnetic field producing means in the developing sleeve 36 and a reference numeral 38 denotes a developer layer thickness restricting blade which forms a thin layer 35*a* of the developer on a surface of the developing sleeve.

The developing sleeve 36 is disposed at a nearest distance (spacing distance) of approximately 500 $\mu$m from the photosensitive body 1 so that the developer layer 35*a* borne on an outside surface of the developing sleeve 36 is brought into contact with the surface of the photosensitive body 1 with a contacting nip width of approximately 3 mm. This contacting nip portion between the developer layer 35*a* and the photosensitive body 1 is the developing section b.

The developing sleeve 36 is driven to rotate around the fixed magnet roll 37 at a peripheral velocity of 105% in the same direction as the rotating direction of the photosensitive body 1 in the developing section b. The two-component developer 35 is adsorbed to the outside surface of the developing sleeve 36 by a magnetic force produced by the magnet roll 37, thereby forming a magnetic brush of the developer 35. The magnetic brush of the developer is carried as the developing sleeve 36 rotates, subjected to layer thickness regulation by the blade 38, carried as the developer layer 35*a* having a predetermined thickness to the developing section b and brought into contact with the surface of the photosensitive body 1, thereafter being returned into a developer container to be carried once again by subsequent rotation of the developing sleeve 36.

Like the first embodiment, the fifth embodiment uses a DC bias as a developing bias applied to the developing roller 32 in image forming and adds an AC component in non-image forming to use different bias between in image forming and in non-image forming, thereby capable of preventing fogging on an image while feeding the charging accelerating particles.

<Others>

1) A configuration of the charging roller 2 used as a flexible contacting charging member is not limited to that of the charging roller used in the second embodiment.

In addition to the charging roller, a fur brush may be used as the flexible contacting charging member. A flexible contacting charging member which is made of felt or cloth or has a form of felt or cloth may also be used. More adequate elasticity and conductivity may be obtained by laminating felt or cloth.

2) In the injection charging mechanism for contacting charging, a charging property is largely dependent on a contacting property of a contacting charging member with a body to be charged. The contacting charging member is therefore composed to have a higher density and rotated at a velocity largely different from a rotating velocity of the body to be charged so that it is brought into contact with the body to be charged at a higher frequency.

It is possible to allow the injection charging mechanism to be governing the contacting charging by adjusting resistance on a surface of the body to be charged with a charge injecting layer formed on the surface of the body to be charged.

Figure 7:
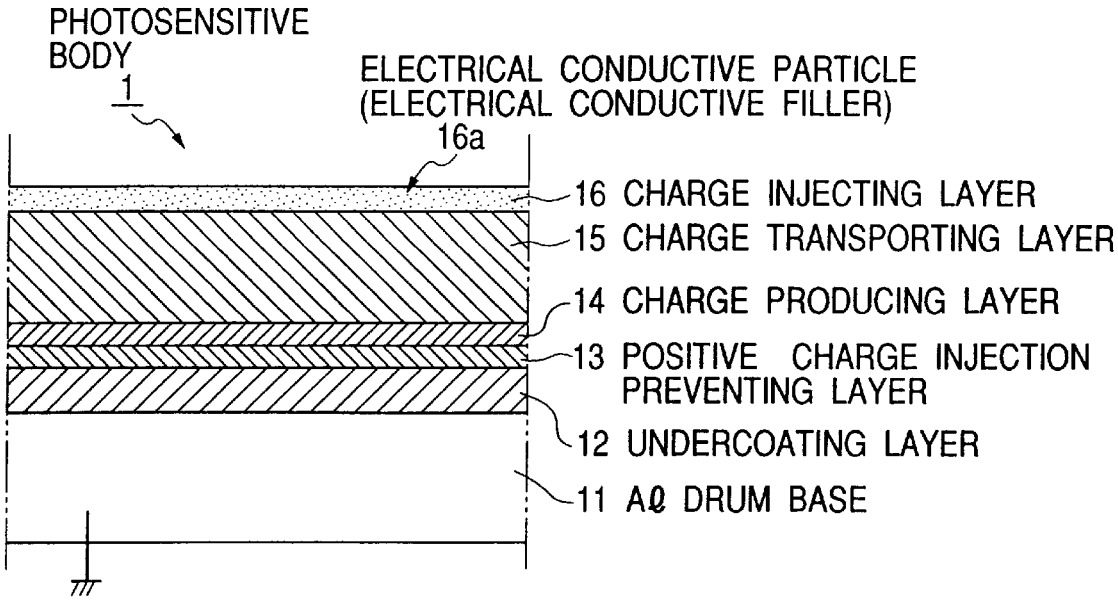
FIG. 7 is a schematic diagram exemplifying a photosensitive body having a charge injecting layer formed on a surface thereof.

FIG. 7 is a schematic diagram showing a layer configuration of the photosensitive body 1 which has a charge injecting layer 16 formed on a surface thereof. The photosensitive body 1 has enhanced charging performance owing to the charge injecting layer 16 coated over an ordinary organic photosensitive body which has an undercoating layer 12, a positive charge injection preventing layer 13, a charge producing layer 14 and a charge transporting layer 15 laminated in this order on an Al drum base 11.

The charge injecting layer 16 is formed by mixing and dispersing ultrafine particles of $SnO_2$ 16*a* (having a diameter of approximately 0.03 $\mu$m) as electrical conductive particles (electrical conductive filler), a lubricant such as tetrafluoroethylene resin (Teflon by trade name), a polymerization initiator and so on in a photosetting acrylic resin as a binder, coating the dispersion and hardening it by a photosetting (photocuring) method.

An important point lies in resistance of a surface layer of the charge injecting layer 16. The charging method which directly charges electric charges can transfer electric charges efficiently when resistance is lowered on a side of the body to be charged. When the charge injection layer 16 is to be used as a photosensitive body, on the other hand, an adequate volumetric resistance of the charge injecting layer 16 is within a range from $1\times10^{9}$ to $1\times10^{14}$ ($\Omega\cdot$cm) since it is necessary to maintain an electrostatic latent image temporarily.

Even when the charge injecting layer 16 is not used unlike the configuration described above, an equivalent effect can be obtained when the charge transporting layer 15, for example, has resistance within the range specified above.

Furthermore, a similar effect can be obtained with an amorphous silicon photosensitive body or the like which has a volumetric resistance of approximately $10^{13}$ $\Omega\cdot$cm on its surface layer.

3) An AC voltage which has a waveform such as a sine waveform, a rectangular waveform or a triangular waveform may be used adequately to apply an AC voltage (alternating voltage) component to the contacting charging member, the developing apparatus or the like. The waveform may be a rectangular waveform which is produced by turning on and off a DC power source periodically. A bias whose voltage value is periodically varies can be used as the alternating voltage which has the waveform described above.

4) Image exposing means to form an electrostatic latent image is not limited to the laser scanning exposure means which forms a digital latent image used in the embodiments, but may be a light emitting element such as an LED which forms an analog latent image by exposing an image, a combination of a light emitting element such as a fluorescent lamp and a liquid crystal shutter, or other means which can form an electrostatic latent image corresponding to image data.

The image bearing body 1 may be an electrostatic recording dielectric body. In this case, a surface of the dielectric body is subjected to primary charging to uniformly charge it at predetermined polarity and potential and then a target electrostatic latent image is written or formed by selectively removing electric charges with charge removing means such as a charge removing needle head or an electron gun.

5) Needless to say, the developing method and configuration of the developing means 3 and 3A adopted for the embodiments are not limitative. The developing means may be regular developing means.

6) The recording medium to which the developer image is transferred from the image bearing body 1 may be an intermediate transfer body such as a transfer drum.

7) A method to measure a particle size of the developer (toner) 31 is exemplified below. Coulter Counter Model TA-2 (manufactured by Coulter K.K.) is adopted as a measuring apparatus, and connected to an interface (manufactured by Nikkaki K.K.) which outputs number average distribution and a volumetric average distribution as well as a CX-1 Personal Computer (manufactured by Canon Inc.), and an aqueous solution of 1% NaCl is prepared as an electrolyte using sodium chloride of first grade.

To measure a particle size distribution, 0.1 to 5 ml of a surface active agent, preferably alkyl benzene sulfonate, is added as a dispersant to 100 to 150 ml of the aqueous solution prepared as the electrolyte and 0.5 to 50 mg of a sample is further added.

The electrolyte in which the sample is suspended is subjected to a dispersing treatment for approximately 1 to 3 minutes with a supersonic dispersing apparatus and a distribution of particles having particle sizes of 2 to 40 $\mu$m is measured with the Coulter Counter Model TA-2 having an aperture diameter of 100 μm, thereby determining a volumetric average distribution. A volumetric average particle diameter is obtained from the volumetric average distribution thus determined.

The present invention is not limited by the embodiments described above, but is modifiable in any ways within a scope of the technical concept of the present invention.

What is claimed is:

1. An image forming apparatus comprising:

an image bearing body;

charging means for charging said image bearing body;

electrostatic image forming means for forming an electrostatic image on said image bearing body charged by said charging means;

developing means for developing the electrostatic image on said image bearing body with a developer containing a toner;

the developer being mixed with charging accelerating particles which is frictionally charged a polarity reverse to that of the toner and accelerates the charging of the image bearing body by said charging means, and said developing means having a developing rotating body which bears the developer containing the charging accelerating particles; and electric field forming means for forming an electric field between said image bearing body and the developing rotating body to supply the charging accelerating particles to said image bearing body in a non-image forming.

2. An image forming apparatus according to claim 1, wherein said electric field forming means applies an AC voltage to said developing rotating body.

3. An image forming apparatus according to claim 1, wherein said developing rotating body contacts with said image bearing body.

4. An image forming apparatus according to claim 1, wherein said developing means has a supplying rotating body, and said apparatus further comprises a voltage applying means which applies a voltage to said supplying rotating body in an image forming and a different voltage to said supplying rotating body in a non-image forming.

5. An image forming apparatus according to claim 1, wherein the charging accelerating particles have a resistance value equal to or less than $1\times10^{12}$ Ω·cm.

6. An image forming apparatus according to claim 1, wherein the charging accelerating particles have a particle diameter equal to or less than ½ of that of the toner.

7. An image forming apparatus according to claim 1, wherein said charging means has a charging member which contacts with a surface of said image bearing body.

8. An image forming apparatus according to claim 7, wherein said charging member moves with a velocity difference from said image bearing body.

9. An image forming apparatus according to claim 1, wherein said image bearing body has a surface layer which contains electrical conductive particles.

10. An image forming apparatus according to claim 1, wherein the charging accelerating particles are not substantially supplied to said image bearing body in a developing.

11. An image forming apparatus according to claim 10, wherein said electric field forming means forms the electric field having an electric field intensity in a direction to lead the charging accelerating particles toward said image bearing body which is higher than that in the developing.

12. An image forming apparatus according to claim 1, wherein the electric field which is formed between said image bearing body and said developing rotating body with a DC voltage is formed in the developing and an electric field intensity in a direction to lead the charging accelerating particles toward said image bearing body is lower than an electric field intensity in a direction to lead the toner to said image bearing body.

13. An image forming apparatus according to claim 1, wherein said apparatus further comprises transfer means for transferring a toner image on said image bearing body to a transfer material and said charging means charges a surface of said image bearing body which is not subjected to cleaning operation after transferring.

* * * * *

UNITED STATES PATENT AND TRADEMARK OFFICE

CERTIFICATE OF CORRECTION

PATENT NO. : 6,226,480 B1
DATED : May 1, 2001
INVENTOR(S) : Jun Hirabayashi et al.

It is certified that error appears in the above-identified patent and that said Letters Patent is hereby corrected as shown below:

Column 7,
Line 12, "tailing" should read -- trailing --.

Column 11,
Line 33, "a nip" should read -- at a nip --.

Column 12,
Line 30, "A" should read -- a --.

Column 14,
Line 9, "are" should read -- is --.

Column 17,
Line 46, "particle" should read -- particles --.

Signed and Sealed this

Second Day of April, 2002

*Attest:*

*Attesting Officer*

JAMES E. ROGAN
*Director of the United States Patent and Trademark Office*